US010287892B2

(12) United States Patent
Ahmad et al.

(10) Patent No.: US 10,287,892 B2
(45) Date of Patent: May 14, 2019

(54) TURBINE BLADE AND TURBINE

(71) Applicant: Siemens Aktiengesellschaft, Munich (DE)

(72) Inventors: Fathi Ahmad, Kaarst (DE); Björn Buchholz, Dinslaken (DE); Stephen A. Camillieri, Fort Mill, SC (US); Nihal Kurt, Düsseldorf (DE); Radan Radulovic, Bochum (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/509,625

(22) PCT Filed: Aug. 27, 2015

(86) PCT No.: PCT/EP2015/069618
§ 371 (c)(1),
(2) Date: Mar. 8, 2017

(87) PCT Pub. No.: WO2016/041761
PCT Pub. Date: Mar. 24, 2016

(65) Prior Publication Data

US 2017/0260863 A1 Sep. 14, 2017

(30) Foreign Application Priority Data

Sep. 16, 2014 (EP) ..... 14184930

(51) Int. Cl.
*F01D 5/14* (2006.01)
*F01D 5/18* (2006.01)

(52) U.S. Cl.
CPC ..... *F01D 5/147* (2013.01); *F01D 5/18* (2013.01); *F05D 2260/20* (2013.01)

(58) Field of Classification Search
CPC ..... F01D 5/147; F01D 5/18; F05D 2260/20
USPC ..... 415/115
See application file for complete search history.

(56) References Cited

U.S. PATENT DOCUMENTS

| | | | | |
|---|---|---|---|---|
| 3,973,874 | A | 8/1976 | Corsmeier et al. | |
| 5,337,805 | A | 8/1994 | Green et al. | |
| 2002/0090294 | A1* | 7/2002 | Keith | F01D 5/189 415/115 |

(Continued)

FOREIGN PATENT DOCUMENTS

| | | | |
|---|---|---|---|
| EP | 1757773 | A1 | 2/2007 |
| EP | 1895102 | A1 | 3/2008 |

(Continued)

OTHER PUBLICATIONS

EP Search Report dated Jan. 19, 2015, for EP patent application No. 14184930.7.

(Continued)

*Primary Examiner* — Aaron R Eastman
(74) *Attorney, Agent, or Firm* — Beusse Wolter Sanks & Maire

(57) ABSTRACT

A turbine blade having an internally cooled turbine blade airfoil in which a hollow space is divided by rib elements into at least one cooling duct carrying a coolant, wherein in at least one of the rib elements a separating tear initiating device for producing a separating tear is disposed, which extends at least partially in the longitudinal direction of the at least one rib element.

18 Claims, 2 Drawing Sheets

(56) References Cited

U.S. PATENT DOCUMENTS

| | | | | |
|---|---|---|---|---|
| 2005/0265839 | A1* | 12/2005 | Mongillo, Jr. ..... | F01D 5/187 416/97 R |
| 2007/0128035 | A1 | 6/2007 | Ahmad et al. | |
| 2008/0232971 | A1 | 9/2008 | Ahmad et al. | |
| 2009/0035128 | A1 | 2/2009 | Ahmad | |

FOREIGN PATENT DOCUMENTS

| | | | |
|---|---|---|---|
| JP | S5151619 | A | 5/1976 |
| JP | H07332004 | A | 12/1995 |
| JP | H08260901 | A | 10/1996 |
| JP | 2000018001 | A | 1/2000 |
| JP | 3456534 | B2 | 10/2003 |
| JP | 2003322003 | A | 11/2003 |
| JP | 2005337256 | A | 12/2005 |
| JP | 2007064219 | A | 3/2007 |
| JP | 2008051104 | A | 3/2008 |
| JP | 4097429 | B2 | 6/2008 |
| JP | 2009517574 | A | 4/2009 |
| JP | 2010190198 | A | 9/2010 |
| WO | 2007012592 | A1 | 2/2007 |

OTHER PUBLICATIONS

International Search Report dated Nov. 23, 2015, for PCT/EP2015/069618.

IPPR (PCT/IPEA/416 and 409) dated Dec. 14, 2016, for PCT/EP2015/069618 (and translation).

JP Office Action dated Jul. 24, 2017, for JP patent application No. 2017520962.

JP second Office Action dated Jan. 5, 2018, for JP patent application No. 2017520962.

* cited by examiner

TURBINE BLADE AND TURBINE

CROSS REFERENCE TO RELATED APPLICATIONS

This application is the US National Stage of International Application No. PCT/EP2015/069618 filed Aug. 27, 2015, and claims the benefit thereof. The International Application claims the benefit of European Application No. EP14184930 filed Sep. 16, 2014. All of the applications are incorporated by reference herein in their entirety.

FIELD OF INVENTION

The invention relates to a turbine blade having an internally cooled turbine blade airfoil, in which a cavity is divided by rib elements into at least one cooling duct carrying a coolant.

The invention further relates to a turbine, in particular a gas turbine, having at least one turbine stage comprising a multiplicity of turbine blades.

BACKGROUND OF INVENTION

Turbine blades of the generic type and also turbines and gas turbines are already well known from the prior art.

Often, such a turbine blade is equipped with an internally cooled turbine blade airfoil, in order to be able to thermally and mechanically withstand even hot prevailing temperatures in the turbine, in particular in a hot gas turbine. It is precisely in hot gas turbines that the turbine blades are often subject to relatively high thermal and mechanical loads, it being of very little importance here whether the turbine blade is a guide vane or a rotor blade of the turbine. In order to allow improved cooling of the turbine blade, such an internally cooled turbine blade airfoil has, according to EP 1 757 773 A1, a hollow space through which a coolant can be passed. In this hollow space, a further rib element or a multiplicity of rib elements are usually additionally arranged, in order to form in the hollow space at least one cooling duct having an often meandering cooling duct path. In particular if the front side face of the turbine blade airfoil and the rear side face of the turbine blade airfoil are not so well balanced out thermally, both such a front side wall and a corresponding rear side wall of the turbine airfoil blade can be subjected to high thermomechanical loads in the region of a rib element which stiffens the turbine blade airfoil. This can result in partially critical stress states occurring on the turbine blade airfoil, whereby the turbine blade is subjected to particularly disadvantageous load states in some areas, which can lead to a more rapid material fatigue in these areas over time. Here, in particular, mention can also be made of the transitional regions between the rib element and the front or rear side wall of the turbine blade airfoil.

SUMMARY OF INVENTION

An object of the invention is to further develop turbine blades of the generic type in order to overcome at least the abovementioned disadvantages.

The present object is achieved by a turbine blade having an internally cooled turbine blade airfoil, in which a hollow space is divided by rib elements into at least one cooling duct carrying a coolant, means for creating a separating tear being arranged in at least one of the rib elements, said separating tear extending at least partially in the longitudinal direction of the rib element. In other words, the rib element comprises a separating tear initiation device.

The separating tear can be created in the rib element in a particularly simple manner if, for this purpose, corresponding means for creating the separating tear are introduced in the related rib element. This can result in the course of the separating tear within the rib element already being well predefined in the longitudinal direction and the transverse direction.

Due to this at least partially achievable separation of the rib element according to the invention, thermomechanically induced stresses in particular can be significantly reduced, especially in transitional regions between the rib element and the outer walls, i.e. the front and rear side walls, the turbine blade, on the front side or the rear side itself, or even within the rib element itself, with the result that material fatigue in such critical areas can be favorably delayed accordingly.

In particular, thermomechanical stresses induced as a consequence of temperature differences between the suction side and the pressure side of the turbine blade airfoil can be significantly reduced in critical areas of the turbine blade airfoil.

The present selectively created separating tear is advantageously formed in such a manner that it allows an improved stress distribution within the rib element, in transitional regions between the actual rib element and the front side wall of the turbine blade airfoil and/or the rear side wall of the turbine blade airfoil, but also in the actual outer walls of the turbine blade airfoil. This can result in a stress reduction of at least 10% or advantageously of more than 20% or 25% being achieved in particular in critical regions around the rib element end but also within the rib element itself.

Within the scope of the invention, the term "material fatigue" covers in particular fatigue crack formation, the latter being induced especially by thermomechanical fatigue of the blade airfoil material.

In this context, mention should be made in particular of LCF fatigue (Low Cycle Fatigue), i.e. short-term or low-load alternation fatigue, relating to a low number of load alternations.

In any case the number of achievable load alternations can be increased considerably in the present case and thus especially the risk of premature LCF fatigue can be significantly lowered if a correspondingly suitable separating tear is provided according to the invention on the rib element. It has been shown that, as a result of the separating tear according to the invention within the rib element, a related LCF life expectancy of a turbine blade can be significantly increased.

Therefore, in the present case, the related rib element is configured in such a manner by the separating tear that thermomechanical stresses occurring within the turbine blade airfoil and thus also related material fatigue can be reduced.

Advantageously, in this case, the separating tear does not impair, or at least only impairs to a negligibly small extent, the actual separating function, which the rib elements arranged in the hollow space perform with respect to a cooling duct with a plurality of winds.

Furthermore, it has likewise been found that the present deliberately intended separating tear within the rib element does not adversely affect the stability of the turbine blade airfoil.

In fact, the service life of the turbine blade increases in the present case, since the respective rib element is considerably relieved of load due to the separating tear.

It is clear that such a separating tear can be provided only at one rib element forming a cooling duct or at a plurality of rib elements bounding the cooling duct.

Within the scope of the invention, the means for creating the separating tear can be configured in various ways.

In terms of construction, the creating means can be provided in a particularly simple manner if the means for creating the separating tear comprise a material weakening, in particular a notch.

Such a material weakening can be of very different types. It is advantageous for it to be a notch formed in the rib element.

A well-functioning tear start point or line-type tear start region on the rib element can be formed in a structurally simple manner by the creating means and especially by means of the material weakening.

The material weakening, or the notch, can be formed as a tear start point on the head side of the rib element or as a tear start line along the longitudinal extent of the rib element.

In the present case, the means for creating the separating tear thus form starting aid means, from which the separating tear spreads through the rib element in the longitudinal direction and/or in the transverse direction.

Furthermore, the creating means can also be provided by a pin arranged on a casting core, by means of which pin a notch is made at the end of the rib element when casting. Following the casting of the turbine blade, the pin is removed with the casting core. The notch then serves as a tear start point for a separating tear, the latter only being able to form during operation when there is a sufficiently large mechanical load and then continuing to grow along the rib.

In the present case, the location of the tear origin can thus be predefined by the position of the notch.

The means for creating the separating tear on the rib element can be realized in a simple manner, in terms of construction and in particular also process engineering if, cumulatively or alternatively, means for creating the separating tear are arranged in a manner driven in on the head side into the at least one rib element.

It is clear that the present means for creating the separating tear that are provided within the scope of the invention can, cumulatively or alternatively, be provided by elements of very different forms.

Correspondingly configured means for creating the separating tear can thus be introduced or driven into the rib element in a particularly simple manner if the means for creating the separating tear comprise a wedge element or a mandrel element.

According to another aspect of the invention, the present object of the invention is also achieved by a turbine blade having an internally cooled turbine blade airfoil, in which a hollow space is divided by rib elements into at least one cooling duct carrying a coolant, at least one of the rib elements comprising means for creating a predetermined breaking point in the at least one rib element, in order to produce a separating tear extending at least partially in the longitudinal direction of the at least one rib element.

If the related rib element comprises such means for creating a predetermined breaking point in the rib element, the course of the separating tear in the longitudinal direction of the rib element can be created in a particularly precisely specified manner. The separating tear thus extends even more precisely through the rib element both in a predefined longitudinal direction and in a predefined transverse direction.

It is advantageous if means for creating the predetermined breaking point comprise a material weakening or a multiplicity of material weakenings within the at least one rib element.

The material weakening and therefore also the predetermined breaking point are configured, for example, in a line-type manner in the longitudinal direction of the rib element, such that the separating tear can develop in a correspondingly defined manner along the rib element.

In the present case, the means for creating the predetermined breaking point form alternative starting aid means, from which the separating tear spreads through the rib element in the transverse direction.

This line-type material weakening, or the predetermined breaking point, can, for instance, be formed as a notch on a longitudinal rib element side in a particularly simple manner in terms of construction.

As an alternative to the line-type material weakening, the predetermined breaking point can also be formed by a multiplicity of point-like material weakenings which are arranged one after the other in a linear manner along the longitudinal extent of the rib element, for example on a longitudinal rib element side.

If the means for creating the predetermined breaking point within the at least one rib element are arranged on both sides of the at least one rib element, the course of the separating tear can be created even more precisely within the rib element.

Furthermore, it is advantageous if the separating tear extends along more than half or along more than two thirds of the length of the at least one rib element, advantageously along the whole length of the at least one rib element. Even with just a separating tear which is formed only partially along the rib element, sufficient decoupling of the front side wall and the rear side wall in the region of the rib element can be achieved.

It is thus also advantageous if the separating tear extends from a first rib element side face to a second rib element side face which is located opposite the first rib element side face.

Here the separating tear spans a separating tear plane, which is arranged substantially perpendicularly to at least one of the rib element side faces. This separating tear plane thus has approximately the same orientation as the outer walls of the turbine blade airfoil.

The object of the invention is also achieved by a turbine, in particular a gas turbine, having at least one turbine stage comprising a multiplicity of turbine blades, the at least one turbine stage comprising turbine rotor blades and/or turbine guide vanes as per a turbine blade according to one of the features described here.

A turbine, the turbine blades of which are less affected or compromised by material fatigue, can not only be operated in a more operationally reliable manner with lower maintenance requirements, but furthermore also has a longer service life overall, and can consequently be operated more cost-effectively.

The rib element is advantageously configured in such a manner that the separating tear is created during start-up of the turbine, that is to say by the rib element overall having such a thin rib element cross section that a tear occurs sooner or later during the operation of the turbine due to a separating tear within the scope of the invention.

Ideally, the separating tear is initiated during start-up on account of the present means for creating the separating tear and/or the means for creating the predetermined breaking point.

In any case the separating tear can advantageously be created within the rib element, when the turbine is in operation.

It is clear that the features of the solutions described above and in the claims can possibly also be combined in order for it to be possible to realize the advantages in a correspondingly cumulative manner.

Further features, effects and advantages of the present invention will be explained on the basis of the enclosed drawing and the subsequent description in which, by way of example, a turbine blade airfoil having a rib element arranged within the turbine blade airfoil, said rib element bounding a cooling duct and being divided according to the invention, is illustrated and described.

DETAILED DESCRIPTION OF INVENTION

Figure 1:
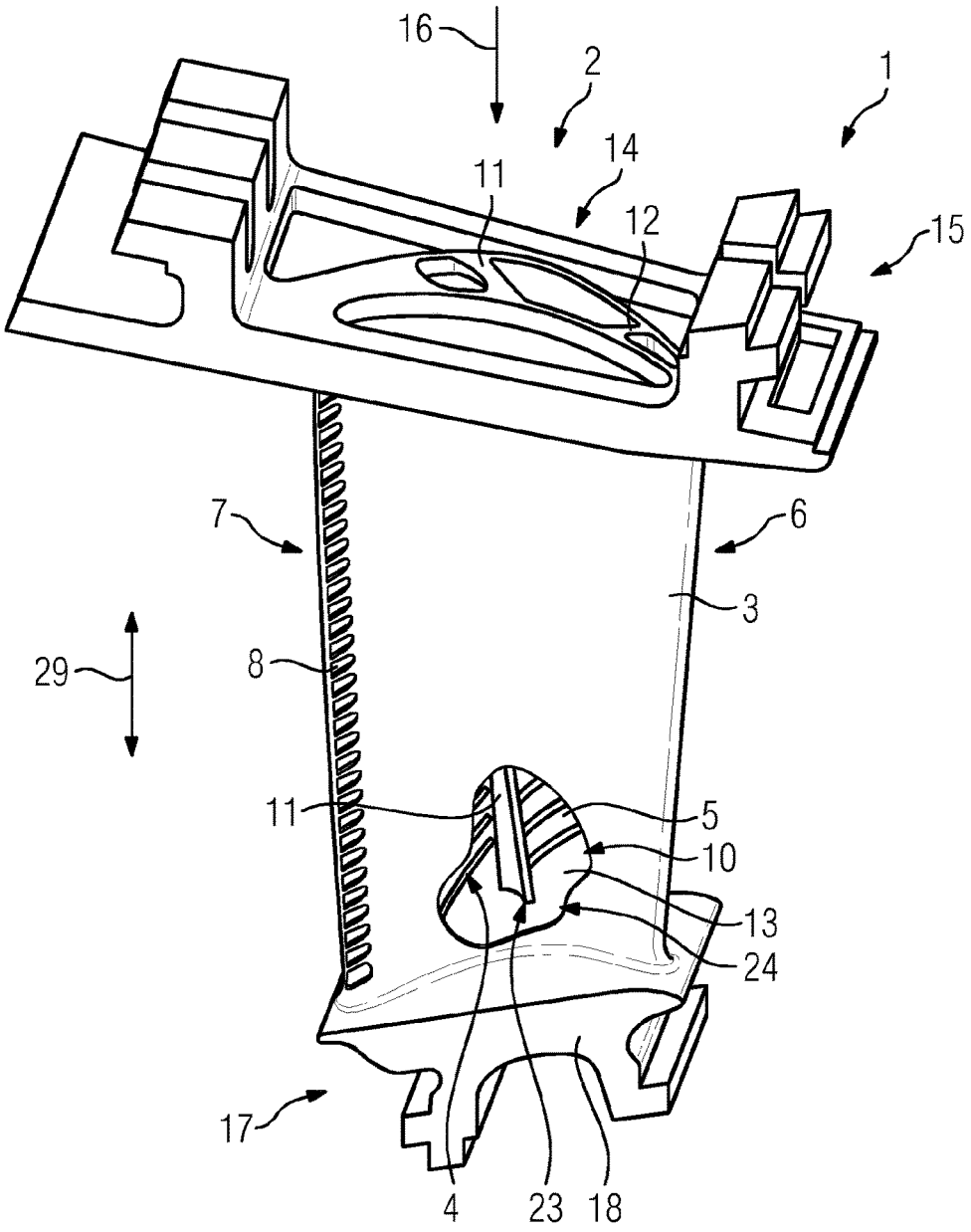
FIG. 1 schematically shows a partial view of a hollow space of a turbine blade airfoil in longitudinal section having a rib element bounding a cooling duct, in which a separating tear within the rib element runs in the longitudinal direction.

The turbine blade 1 shown at least partially in FIG. 1 is a guide vane 2 of a hot gas turbine (not shown here).

The turbine blade 1 has an internally cooled turbine blade airfoil 3, the inner side 4 of the front side wall 5 of the turbine blade airfoil 3 being shown at least partially in the illustration of FIG. 1. A front edge region 6 of the turbine blade airfoil 3 is situated on the right-hand side. A rear edge region 7 of the turbine blade airfoil 3 is accordingly situated on the left-hand side, on which there is a multiplicity of cooling-air outlet openings 8 (numbered here merely by way of example).

In any case, the turbine blade airfoil 3 has a hollow space 10, this hollow space 10 being illustrated only partially through the inner side 4 in the illustration according to FIG. 1.

In the illustration according to FIG. 1, two rib elements 11 and 12 situated in the hollow space 10 can also be seen, by means of which a cooling duct with a plurality of winds 13 having a meandering cooling duct path is formed within the hollow space 10. Along the winding cooling duct 13, or the meandering cooling duct path thereof, cooling air acting as a coolant can be guided through the turbine blade airfoil 3 in order to cool the latter from the inside.

In the case of the partially shown cooling duct 13, the cooling air coming from a root region 14 of the turbine blade root 15 flows through the turbine blade airfoil 3, part of the cooling air further reaching a region 17 of the turbine blade airfoil tip 18 in direction 16.

The meandering cooling duct course of the winding cooling duct 13 is formed by the two rib elements 11 and 12 at least in the region of the partial view shown, the first rib element 11 physically separating two cooling duct sections from each another.

As shown in the illustration according to FIG. 1, the first rib element 11 ends with its rib element end 24, which is defined by its head side 23, free in the cooling duct 13.

In the surrounding regions of the rib elements 11 and 12, in particular of the rib element end 24, there is the risk of critical stress states. This applies in particular to the transitional regions between the first rib element 11 and the front side wall 5 of the turbine blade airfoil 3 and/or the rear side wall of the turbine blade airfoil 3, related stresses there being able to give rise to increased material fatigue.

Figure 2:
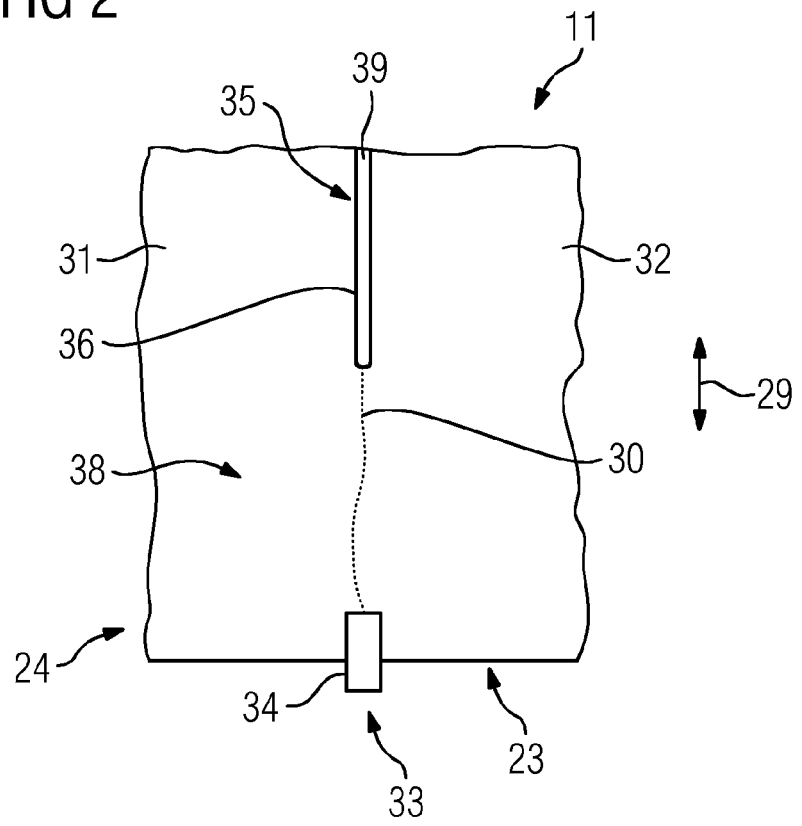
FIG. 2 schematically shows a side view of the rib element shown in FIG. 1 in a region of a head side on a rib element end, at which means for creating the separating tear are arranged.

Therefore, in particular, as indicated in the illustration according to FIG. 2, the rib element 11 is divided in its longitudinal direction 29 at least partially by a separating tear 30 into a longitudinal rib element half 31 connected cohesively to the front side wall 5 of the turbine blade airfoil 3 and into a further longitudinal rib element half 32 connected cohesively to the rear side wall (not shown) of the turbine blade airfoil 3. Due to this separating tear 30 which extends through the rib element 11, thermomechanical stresses within the turbine blade airfoil 3, in particular, can be significantly reduced, as a result of which the risk of premature material fatigue at the surrounding regions 28 is also reduced.

In order to be able to create the separating tear 30 on the rib element 11 in a constructively simple manner, corresponding means 33 for creating the separating tear 30, extending at least partially in the longitudinal direction 29 of the rib element 11, are arranged on the head side 23, in the form of a wedge element 34. The means 33, as already mentioned further above, can also be referred to as a separating tear initiation device.

Here the wedge element 34 has been inserted through a functional opening which is present in the turbine blade 1 (but not shown here) and hammered into the head side 23 of the rib element 11 in the process.

In order to make the course of the separating tear 30 on the rib element 11 precise, further means 35 for creating a predetermined breaking point 36 in the form of notches 39 which extend in a linear manner on both rib element side faces 37 and 38, are additionally realized on the rib element 11 in this exemplary embodiment. These notches 39 thus form a tear start point or a tear start line (not numbered separately) on the rib element 11.

The predetermined breaking point 36, or the tear start line, can extend along the whole length of the rib element 11 or, as shown in this exemplary embodiment, only along section of the rib element 11. What is decisive is that a material weakening is provided at least sectionally on the corresponding rib element 11 in order to create a precisely extending separating tear 30.

If necessary, the means 33 for creating the separating tear 30 can then be dispensed with entirely.

It is also conceivable that the means 33 for creating the separating tear 30 can also be provided in the casting core of a casting mold, in order to produce only one notch as a tear start point on the rib element 11. The means 33 for creating the separating tear 30 are subsequently removed again with the casting mold and just the notch remains on the rib element 11.

Although the invention has been illustrated and described in detail by the preferred exemplary embodiment, the invention is not limited by this disclosed exemplary embodiment, and other variations can be derived therefrom by a person skilled in the art without departing from the scope of protection of the invention.

The invention claimed is:

1. A turbine blade comprising:

an internally cooled turbine blade airfoil, in which a hollow space is divided by rib elements into at least one cooling duct carrying a coolant, wherein, as a tear start point, means for creating a separating tear are arranged in at least one rib element of the rib elements, wherein said means for creating a separating tear and a thickness of the at least one rib element together are configured to render the at least one rib element structurally insufficient to withstand operating stress present on the turbine blade during operation in a gas turbine engine such that the operation of the turbine blade in the gas turbine engine causes a separating tear to form in the at least one rib element, wherein the separating tear extends at least partially in a longitudinal direction of the at least one rib element, and wherein the turbine blade is configured to continue to operate once the separating tear is formed, and wherein the means for creating a separating tear comprises a notch formed in a perimeter of the at least one rib element at a tip of the at least one rib element.

2. The turbine blade as claimed in claim 1, comprising an element driven into a head side of the at least one rib element to form the notch.

3. The turbine blade as claimed in claim 1, comprising a wedge element driven into the at least one rib element to form the notch.

4. A turbine or a gas turbine, comprising:

at least one turbine stage comprising a multiplicity of turbine blades, wherein the at least one turbine stage comprises at least one of turbine rotor blades and turbine guide vanes as per a turbine blade as claimed in claim 1.

5. The turbine blade as claimed in claim 1, wherein the means for creating a separating tear are configured such that the separating tear is generated during startup of the gas turbine engine.

6. A turbine blade comprising:

an internally cooled turbine blade airfoil, in which a hollow space is divided by rib elements into at least one cooling duct carrying a coolant, wherein at least one rib element of the rib elements comprises: means for creating a predetermined breaking point in the at least one rib element configured to produce a separating tear extending at least partially in a longitudinal direction of the at least one rib element during operation of the turbine blade in a gas turbine engine; and the separating tear, and wherein the turbine blade is configured to operate with the separating tear, and wherein the means for creating a predetermined breaking point comprises a notch formed in a perimeter of the at least one rib element at a tip of the at least one rib element.

7. The turbine blade as claimed in claim 6, further comprising:

further means for creating a predetermined breaking point are arranged in at least one of the rib elements, said means for creating a predetermined breaking point and the further means for creating a predetermined breaking point are together configured to generate the separating tear such that the separating tear extends at least partially in the longitudinal direction of the at least one rib element.

8. The turbine blade as claimed in claim 6, wherein the means for creating a predetermined breaking point within the at least one rib element is arranged on both a front edge side and a rear edge side of the at least one rib element.

9. The turbine blade as claimed in claim 6, wherein the means for creating a predetermined breaking point are configured such that the separating tear produced extends along more than half of a length of the at least one rib element.

10. The turbine blade as claimed in claim 9, wherein the means for creating a predetermined breaking point are configured such that the separating tear produced extends along more than two thirds of the at least one rib element.

11. The turbine blade as claimed in claim 9, wherein the means for creating a predetermined breaking point are configured such that the separating tear produced extends along a whole length of the at least one rib element.

12. The turbine blade as claimed in claim 6, wherein the means for creating a predetermined breaking point are configured such that the separating tear produced extends from a first rib element side face to a second rib element side face which is located opposite the first rib element side face.

13. A method, comprising:

casting an unfinished turbine blade comprising: an internally cooled turbine blade airfoil in which a hollow space is divided by a rib element into at least one cooling duct carrying a coolant; and a means for creating a separating tear in the rib element, wherein the means for creating the separating tear is configured to form the separating tear during operation of the unfinished turbine blade in a gas turbine engine, wherein the unfinished turbine blade becomes a finished turbine blade when the separating tear is formed during the operation, and wherein the finished turbine blade is configured for continued operation in the gas turbine engine, and forming the finished turbine blade by using the unfinished turbine blade in the gas turbine engine until the separating tear forms.

14. The method of claim 13, further comprising:

continuing operation of the gas turbine engine using the finished turbine blade.

15. The method of claim 13, further comprising:

forming the means for creating the separating tear by incorporating a material weakening in the rib element.

16. The method of claim 13, further comprising:

forming the means for creating the separating tear by driving an element into a head side of the rib element to form a notch, wherein the means for creating the separating tear comprises the notch.

17. A turbine blade comprising:

an internally cooled turbine blade airfoil, in which a hollow space is divided by rib elements into at least one cooling duct carrying a coolant, wherein, as a tear start point, means for creating a separating tear are arranged in at least one rib element of the rib elements, wherein said means for creating a separating tear and a thickness of the at least one rib element together are configured to render the at least one rib element structurally insufficient to withstand operating stress present on the turbine blade during operation in a gas turbine engine such that the operation of the turbine blade in the gas turbine engine causes a separating tear to form in the at least one rib element, wherein the separating tear extends at least partially in a longitudinal direction of the at least one rib element, and wherein the turbine blade is configured to continue to operate once the separating tear is formed, and an element driven into a head side of the at least one rib element to form a notch, wherein the means for creating the separating tear comprises the notch.

18. A turbine blade comprising:

an internally cooled turbine blade airfoil, in which a hollow space is divided by rib elements into at least one cooling duct carrying a coolant, wherein, as a tear start point, means for creating a separating tear are arranged in at least one rib element of the rib elements, wherein said means for creating a separating tear and a thickness of the at least one rib element together are configured to render the at least one rib element structurally insufficient to withstand operating stress present on the turbine blade during operation in a gas turbine engine such that the operation of the turbine blade in the gas turbine engine causes a separating tear to form in the at least one rib element, wherein the separating tear extends at least partially in a longitudinal direction of the at least one rib element, and wherein the turbine blade is configured to continue to operate once the separating tear is formed, and a wedge element driven into the at least one rib element to form a notch, wherein the means for creating the separating tear comprises the notch.

* * * * *